US005715546A

United States Patent [19]

Kvalvik

[11] Patent Number: 5,715,546

[45] Date of Patent: Feb. 10, 1998

[54] TUB CUSHION

[76] Inventor: Prerna J. Kvalvik, 1108 Lawrence St., New London, Wis. 54961-1849

[21] Appl. No.: 726,202

[22] Filed: Oct. 4, 1996

[51] Int. Cl.[6] ..... A47K 3/02

[52] U.S. Cl. ..... 4/580; 4/DIG. 18

[58] Field of Search ..... 4/580, 581, 582, 4/583, DIG. 18

[56] References Cited

U.S. PATENT DOCUMENTS

| | | | |
|---|---|---|---|
| 1,019,212 | 3/1912 | Yates . | |
| 2,080,601 | 5/1937 | Cappuccio | 4/580 |
| 2,084,852 | 6/1937 | Lochman | 4/584 |
| 3,045,254 | 7/1962 | Cook et al. . | |
| 3,133,292 | 5/1964 | Spier | 4/580 |
| 3,585,991 | 6/1971 | Balamuth | 4/541.1 X |
| 3,931,652 | 1/1976 | Navarra | 4/580 X |
| 4,069,523 | 1/1978 | Ridgeway . | |
| 4,630,323 | 12/1986 | Sage et al. . | |
| 5,144,703 | 9/1992 | Maire . | |

FOREIGN PATENT DOCUMENTS

| | | | |
|---|---|---|---|
| 316274 | 5/1989 | European Pat. Off. . | |
| 3134256 | 3/1983 | Germany | 4/580 |
| 376981 | 8/1932 | United Kingdom . | |
| 453561 | 10/1936 | United Kingdom . | |

*Primary Examiner*—Charles E. Phillips

[57] ABSTRACT

A bathtub cushion is formed of a resilient material, such as a closed cell plastic foam. The cushion covers the interior of the bottom of the tub, extending upwardly to cover the interior walls of the tub and the edges or rim of the tub. The cushion may be formed as a sheet of uniform thickness, on the order of one to two inches thick, or may alternatively be formed with a thinner bottom portion and thicker upper walls and upper edge, to better cushion any impact of a bather who might slip in the tub. The cushion is removably secured within the tub by suction cups disposed about the entire tub contact surface of the cushion, and includes drainage grooves formed in the upper surface of the bottom portion to facilitate drainage. The cushion may also include a head rest, which may include a radio, cassette deck, or other audio system therein, as desired. The cushion may be formed to fit within a conventional generally rectangular or oval bathtub, and may also be configured to fit within a hot tub having a round or other shape. The present cushion adds a significant measure of safety for a bather, with its high friction surface to reduce slippage and the thickly cushioned upper edge to reduce the likelihood of injury in the event of a fall. A significant increase in comfort is also provided by the padding and optional headrest and audio system.

16 Claims, 4 Drawing Sheets

TUB CUSHION

BACKGROUND OF THE INVENTION

1. FIELD OF THE INVENTION

The present invention relates generally to liners and inserts for bathtubs, hot tubs, and the like, and more specifically to a cushioned insert preferably formed of a closed cell foam plastic material and extending around the entire upper periphery of the tub. The cushion not only provides comfort for the bather, but also serves as a safety device due to the padding and cushioning disposed about the interior and upper edge of the tub. Additional convenience features (built in radio and/or audio system and head rest, etc.) may be provided as desired.

2. DESCRIPTION OF THE PRIOR ART

Regular bathing is of course a necessity of life, but may also serve as a luxurious break from the routine for a person who wishes to soak in a tub. Conventional bathtubs, hot tubs, and the like are not well suited for comfort, however, with their hard and non-porous enameled metal or hard fiber glass or plastic shells. It should also be noted that the bathroom has been found to be one of the most hazardous areas of the home, with bathtub falls accounting for a high percentage of minor and serious injuries in the home each year, due to the hard and slippery tub surface.

Accordingly, a need will be seen for a tub cushion which is adapted to fit closely within a given tub shape (conventional bathtub, round hot tub, etc.). The cushion not only covers the bottom of the tub, but extends up the sides and over the rim or edge of the tub, to soften the impact if a bather should slip and fall against the edge of the tub. The relatively soft bottom portion of the cushion also provides additional comfort for infants, toddlers, and young, adult, and elderly bathers. The closed cell foam material preferably used provides a good friction surface to reduce slippage in the tub, and the surface of the cushion contacting the tub is also adapted to provide a good grip with the tub surface. Additional comfort features may be provided, such as a headrest, which may include a radio and/or other audio device installed therein. A discussion of the prior art of which the inventor is aware, and its differences from the present invention, is provided below.

U.S. Pat. No. 1,019,212 issued on Mar. 5, 1912 to William Yates describes a Mat comprising a corrugated sheet of rubber adapted to be placed in the bottom of a bathtub. The device does not extend up the sides of the interior of the tub, nor over the edges or rim of the tub, where contact is most likely to be made by a person who slips in the tub. No suction cup attachment to the interior of the tub is disclosed, as provided by the present tub cushion. Also, no provision is made for a head rest or other comfort and convenience features along the rim, as the Yates mat does not extend above the bottom of the tub.

U.S. Pat. No. 3,045,254 issued on Jul. 24, 1962 to Robert G. Cook et al. describes a Bathtub With Liner, comprising an inner foam rubber cushion with a relatively hard plastic shell thereover. The foam cushion extends beneath the bottom of the shell and up the sides thereof, between tub and shell. However, the foam cushioning does not extend over the edge of the tub, between tub edge and shell edge, to soften the impact of a person falling on the edge of the tub. Moreover, the Cook et al. tub liner is secured about the upper edge of the tub, rather than by attachment means distributed over the entire underside of the liner, as in the present cushion. Thus, the Cook et al. tub liner requires a specially formed tub having an outer attachment lip for the attachment of the liner thereto, unlike the present tub cushion. Cook et al. make no provision for a head rest or audio system for their liner.

U.S. Pat. No. 4,069,523 issued on Jan. 24, 1977 to Louis H. Ridgeway describes a Bathtub With Cushioned Liner Of Foam Plastic. As the title of the patent states, the device is not only a liner, but comprises an entire specially constructed tub, unlike the present cushion which may be removably installed within an existing conventional tub. The Ridgeway tub has a cushioned foam liner extending upwardly along the sides and over the upper edges of the tub, but the liner is relatively thin compared to the present cushion, which is preferably one to two inches thick. No particular drain channel configuration is disclosed by Ridgeway, and as the liner and tub are formed integrally, no removable attachment means is provided for the liner.

U.S. Pat. No. 4,630,323 issued on Dec. 23, 1986 Dennis R. Sage et al. describes a Bathtub Liner comprising a plurality of generally flat sections which may be assembled to line a generally rectangular tub. None of the sections extend upwardly to cover the upper edge or rim of the tub, with the exception of a head rest portion which is not immediately adjacent its accompanying section of cushion, but is secured thereto with a relatively wide and thin band of material. No audio system is disclosed within the head rest, as provided by the present cushion. The liner is thinner near the upper edge, rather than thicker to provide greater protection in the case of a fall, as in the case of the present tub cushion. No special means is provided for drainage, other than sloping the upper surface of the bottom sheet.

U.S. Pat. No. 5,144,703 issued on Sep. 8, 1992 to Laura M. Maire describes a Bathtub Liner somewhat similar to the folding liner of Sage et al. discussed above. The Maire liner is quite complex, having three walls in the bottom portion thereof to define two parallel spaces therein. The lowermost space is adapted to receive sand or other relatively heavy particulate matter, to serve as a weight to hold the liner down. The second, upper space serves to receive air or water therein, for additional cushioning. The present cushion provides sufficient thickness, along with the slight space between the bottom of the cushion and the tub itself due to the suction cup attachment, to provide sufficient cushioning without the complexity of a multiple chambered bottom portion. No specific drainage channels or audio system is disclosed by Maire.

British Patent Publication No. 376,981 published on Aug. 11, 1932 describes Improvements Relating To Baths, Sinks, Wash and Lavatory Basins And Other Receptacles. The improvement is a relatively thin rubber liner which must be specially cast to fit each specific tub configuration for which it is intended. The disclosure states that the liner may be of uniform thickness, or may be thicker in the bottom portion. No mention is made of any provision for a thicker upper portion and upper edge, as is provided by the present cushion. No particular drainage means, head rest, or other features of the present cushion are disclosed.

British Patent Publication No. 453,561 published on Oct. 8, 1936 describes Improvements In And Relating To Household Baths, Sinks, Wash Or Lavatory Basins. The disclosure is simply a conventional tub coated with rubber on the inner and optionally the outer surface. None of the features of the present invention are disclosed, e. g., removable attachment means, drainage means, headrest and/or audio system means, etc.

Finally, European Patent Publication No. 316,274 published on May 17, 1989 illustrates a liner formed of a flat sheet of material, foldable to form an enclosure or liner. No particular thickness is disclosed, nor is any resilience or cushioning apparent. None of the features of the present invention are disclosed, e. g., removable attachment means, drainage means, headrest and/or audio system means, etc.

None of the above inventions and patents, either singly or in combination, is seen to describe the instant invention as claimed.

SUMMARY OF THE INVENTION

Accordingly, it is a principal object of the invention to provide an improved tub cushion which is formed as a single, unitary component of a resilient material, and which is adapted to conform closely to the interior of a conventional bath tub, hot tub, or the like and to cover the bottom, sides, and upper edges or rim of the tub, thereby reducing the likelihood of injury to a bather who falls in the tub.

It is another object of the invention to provide an improved tub cushion which may be formed of a closed cell foam material, and which cushion material may be dyed or otherwise colored as desired.

It is a further object of the invention to provide an improved tub cushion including drain channels therein adapted to facilitate drainage of the cushion toward the drain of the tub in which the cushion is installed, and further including tub attachment means, such as suction cups, disposed generally uniformly beneath the entire cushion to provide generally uniform attachment to substantially the entire tub into which the cushion is placed.

An additional object of the invention is to provide an improved tub cushion which may include a head rest, and which head rest may include audio means such as a radio or tape unit therein.

Still another object of the invention is to provide an improved tub cushion which upper edges may be thicker than the bottom surface thereof, with side walls tapering in thickness from a thickest portion at the top to a thinnest portion at the bottom to provide maximum cushioning around the tub edges.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
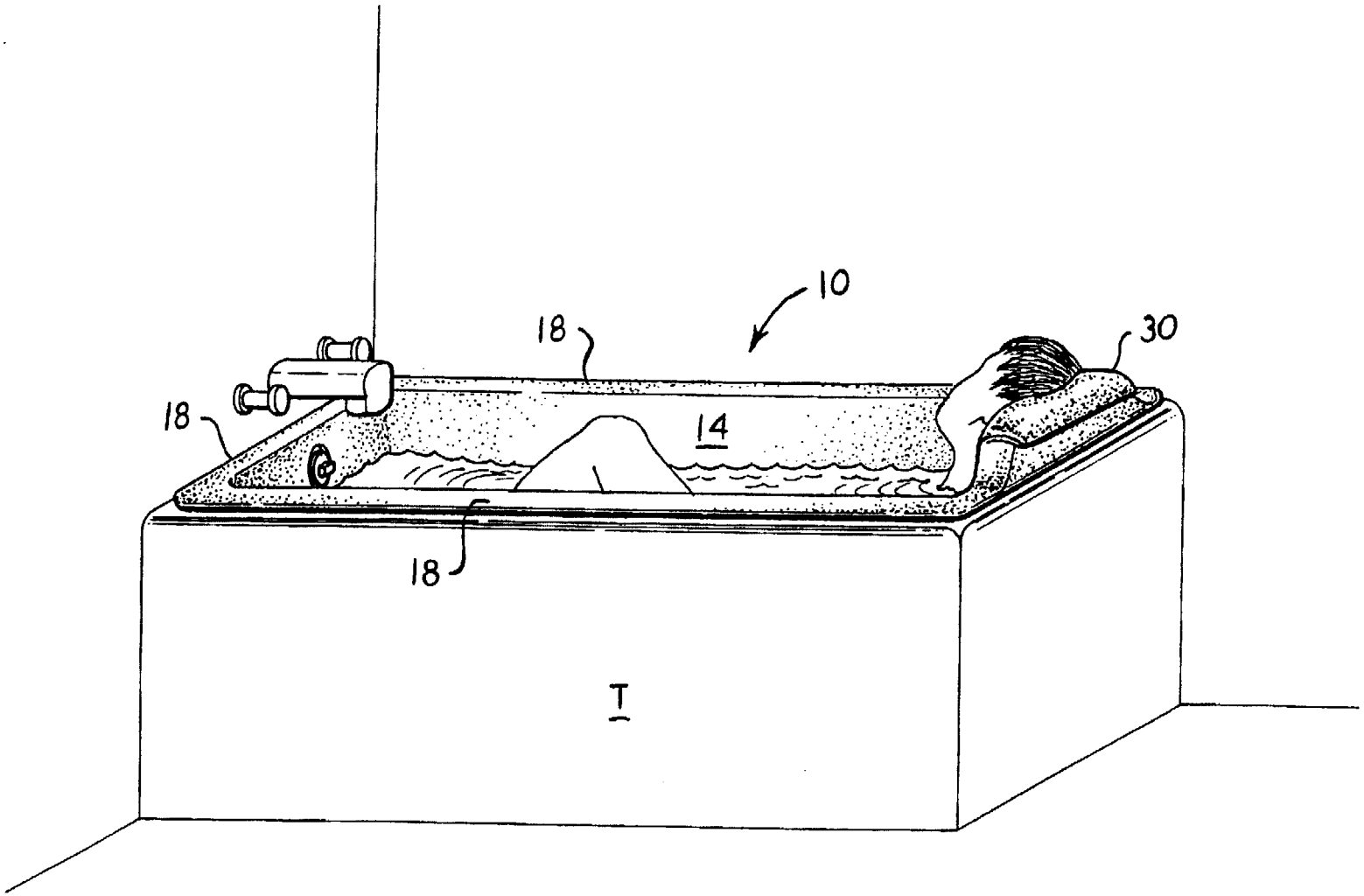
FIG. 1 is an environmental perspective view of the present tub cushion installed in a conventional bathtub, showing its upper edge overlapping the edge of the tub and the optional head rest.
Figure 2:
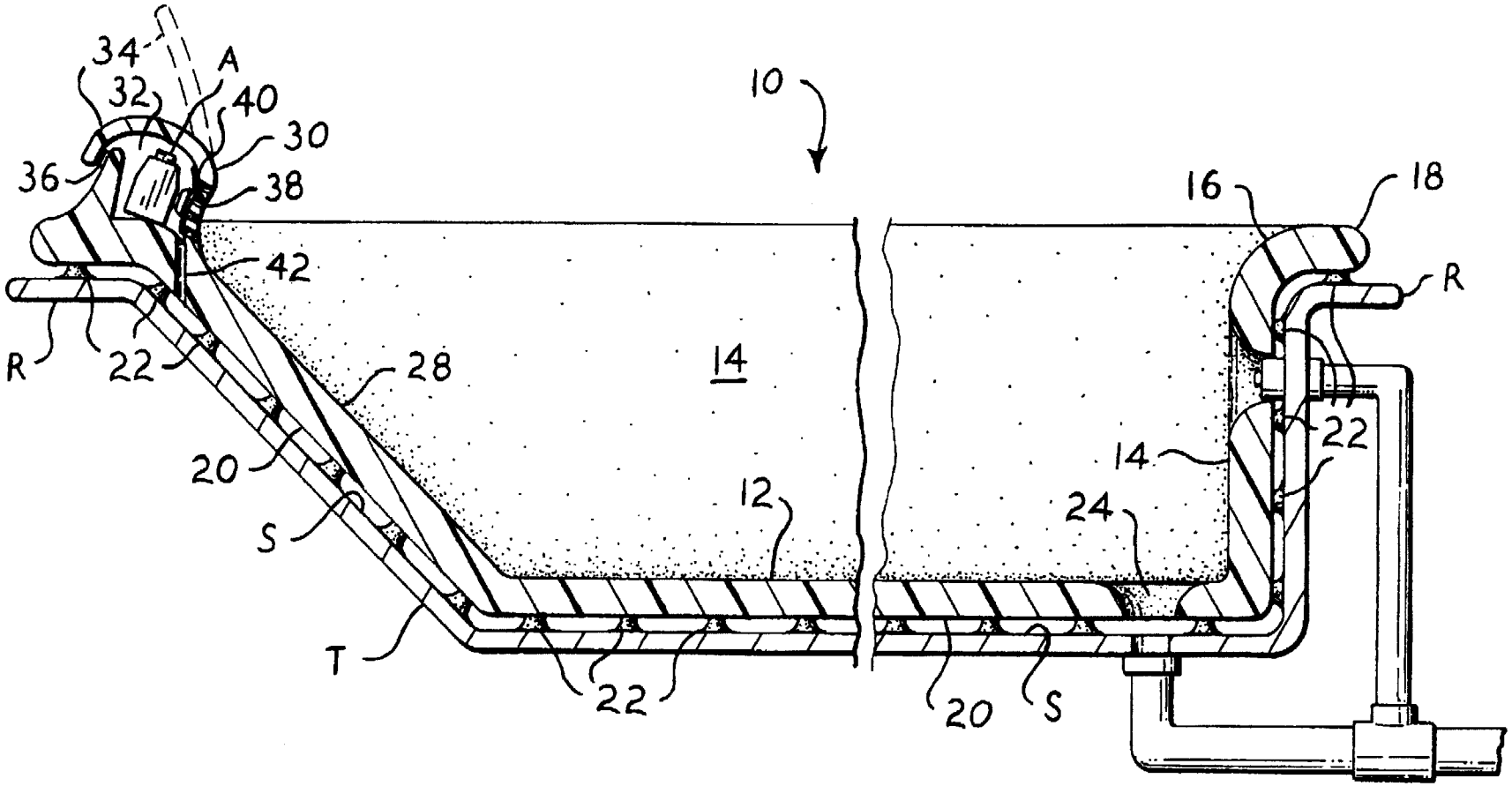
FIG. 2 is a side elevation view in section showing further details of the present tub cushion, such as the suction cup attachment means and details of the optional head rest and audio system enclosed therein.

The present invention comprises various embodiments of a tub cushion, one embodiment of which is disclosed in FIGS. 1 and 2 and designated with the numeral 10. The cushion 10 is formed of a resilient material which serves to reduce injury to a bather who might fall in the tub, by cushioning the impact resulting from such a fall. Preferably, the cushion 10 is formed of a closed cell foam plastic material as a single continuous and unbroken sheet having a homogeneous interior devoid of spaces, pockets, or other structure therein. The use of closed cell foam material precludes the absorption of water therein, as an open cell sponge would do, and provides further cushioning action due to the encapsulated air or gas bubbles within the closed cell material.

Figure 5:
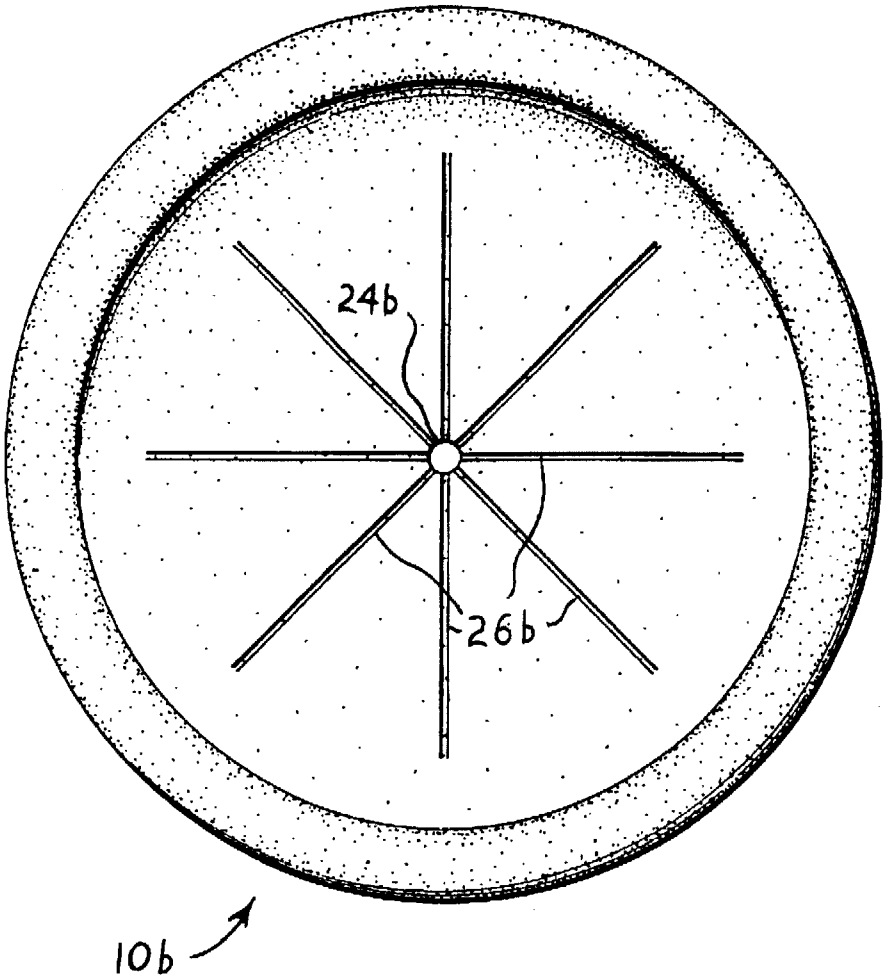
FIG. 5 is a top plan view of an alternate embodiment of the tub cushion for a hot tub, showing the drainage channels therefor.
Figure 4:
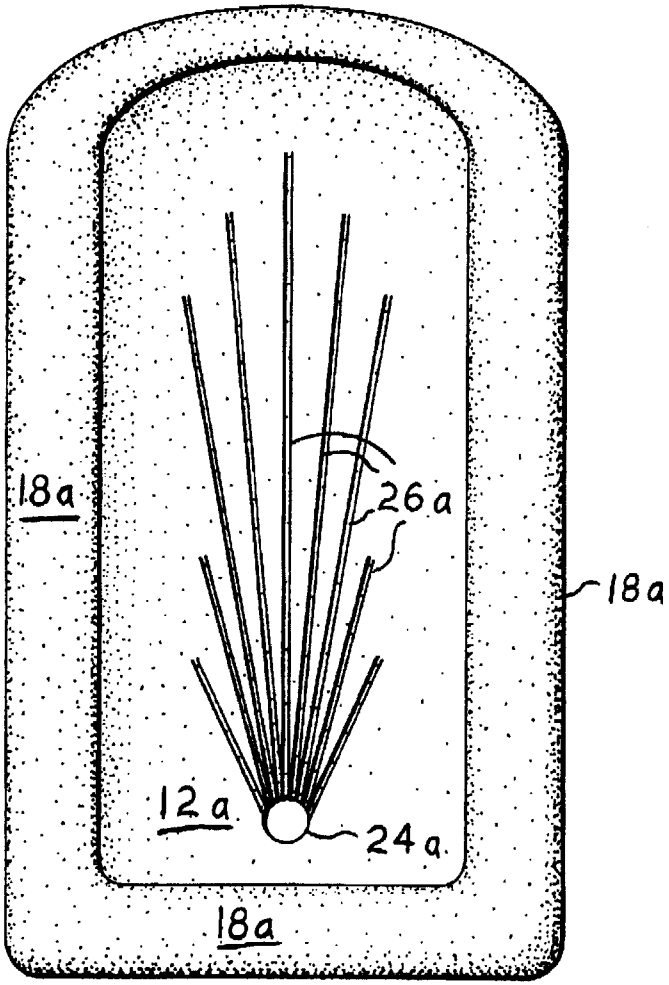
FIG. 4 is a top plan view of one embodiment of the cushion for a conventional bathtub, showing the drainage channels therefor.

The present tub cushion 10 is formed in the shape of a liner to fit reasonably closely within the bathtub B of FIG. 1, but may be formed in any one of a number of different shapes and configurations to fit various shapes and configurations of conventional tubs, such as the generally rectangular bathtub T of FIG. 1, or a tub having at least one rounded or oval end, as in the cushion of FIG. 4, or even a square, rectangular, or round hot tub, such as the round hot tub shape shown in FIG. 5. It will be understood that the present tub cushions in their various embodiments need not be formed to fit a given tub shape precisely, but that the resilient nature of the material used will permit, a given tub cushion to conform somewhat to fit a tub having a generally similar size and shape.

The tub cushion 10 comprises a bottom portion 12, a plurality of side walls 14 having a common upper edge 16, with a rim 18 extending outwardly from the upper edge 16 of the cushion 10 to cover the upper edge or rim R of the tub T, as shown in FIG. 2. The cushion 10 is relatively thick in order to provide good impact protection in the case of a fall within the tub T, having a thickness preferably between one and two inches.

Figure 3:
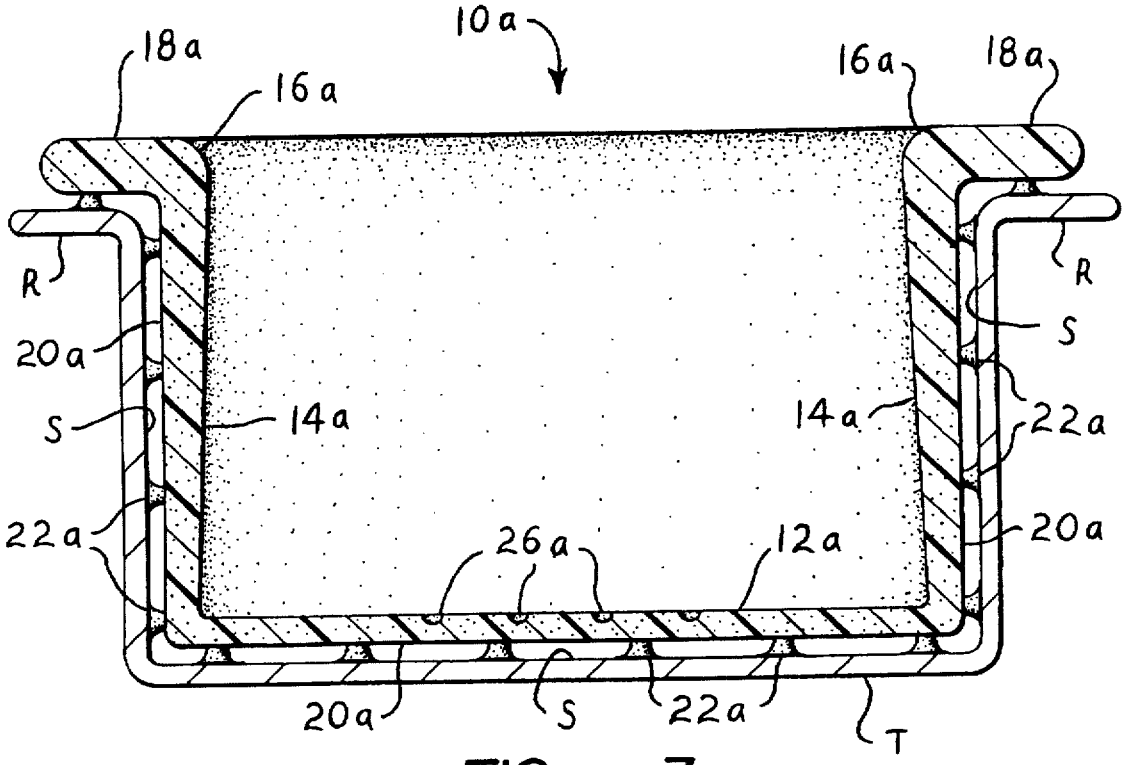
FIG. 3 is an end elevation view in section showing further details, such as the thicker upper portions of the side walls and upper edges of the cushion and the drain channels in the bottom of the cushion.

Alternatively, the thickness may vary as shown in the cushion **10*a* embodiment of FIGS. 3 and 4, with the bottom portion 12*a* being relatively thin, e.g. on the order of one inch, or perhaps only one half inch, with the cushion rim 18*a* being much thicker, e. g., on the order of two inches thick. The walls 14*a* preferably taper uniformly from their thickest point at their upper edges 16*a* to their lowermost edges which meet with the bottom portion 12*a*. In this way, the tub cushion 10*a* provides optimum padding for the upper edge or rim R of the tub T, with any water in the tub T and cushion 10*a*** serving to cushion the impact of a fall into the bottom of the tub T.

The present tub cushion in each of its embodiments includes an outer surface **20/20*a* which is adapted to be positioned generally adjacent the inner surface S of the tub T, as shown respectively in FIGS. 2 and 3. This tub cushion outer surface 20/20*a* includes tub attachment means extending therefrom, e. g., a plurality of small suction cups 22/22*a*, disposed generally uniformly over the entire outer surface 20/20*a* of the cushion 10/10*a*, and serving to secure the cushion 10/10*a*** removably to the tub T.

It will be seen that some provision for draining the interior of the present tub cushion **10/10*a* is required. Accordingly, a drain opening, respectively 24/24*a*, is provided for the tub cushions 10/10*a* of FIGS. 2 and 3. A plurality of drain channels 26a and shown in FIGS. 3 and 4, extends radially away from their respective drain openings 24/24a to channel water from the bottom portion 12/12a of the cushion 10/10a. (It will be understood that similarly configured channels, not shown, may be provided in the bottom surface 12 of the cushion 10 shown in FIGS. 1 and 2.) These channels 26a, along with the relatively high friction surface of the material of the cushion 10/10a, also provide additional traction or grip for the bather using the present tub cushion 10/10a in its various embodiments. An alternative drain channel configuration 26b is shown in the round or circular hot tub cushion 10b of FIG. 5, with the drain channels 26b extending radially away from a central drain opening 24b**.

Additional comfort and convenience for the bather using the present tub cushion 10 may be provided by a head rest 28 extending upwardly from the rear wall 30 of the cushion 10. Preferably, the head rest 28 is formed integrally with and immediately adjacent the rear wall 30 and the remainder of the tub cushion 10, rather than as a separate component or having some intermediate component therebetween. The head rest 30 is preferably formed of a closed cell foam material, the same as the balance of the cushion 10. The head rest 30, or equivalent structure, may also be formed on any of the other embodiments of the present tub cushion, as desired.

Many bathers also enjoy listening to music or other sounds as they relax in a tub, and provision for such may be made by means of the head rest 30 discussed above. Modern electronics has provided relatively small and efficient radios, cassette tape players, and other audio devices, and the head rest 30 will be seen to have sufficient size to incorporate such a device therein, if the head rest 30 is hollowed and modified to accept such an audio device.

FIG. 2 shows such a modified head rest 30, having a space 32 therein which is accessible by a closure flap 34 formed integrally with the remainder of the tub cushion 10 and head rest 30. The flexible and resilient nature of the material allows it to be opened as desired, with one edge acting as a live hinge and the opposite edge being secured by some closure means, e. g., mating hook and loop fastening material 36. A speaker grille 38, sealed with a thin, water impervious plastic sheet 40, may be provided to the front of the audio device enclosure space 32, with a drain passage 42 being provided from the bottom of the space 32 to the outer surface 20 of the tub cushion 10. The audio device A may comprise an AM/FM radio, a tape cassette player, CD player, etc., and the controls may be accessed through the upper panel 34 as desired. Preferably, the audio equipment A is battery powered, to reduce electrical shock hazard, but the placement of the audio device A high in the head rest 30, with the closure 34, speaker grille seal 40, and drain passage 42, serve to make insignificant any slight hazard which might otherwise occur.

In summary, the present tub cushion 10, in any of its various embodiments, will be seen to enhance both the safety and comfort of the bather using the device. The cushion 10 or other embodiments thereof may be molded or shaped to conform closely to the interior of conventional bathtubs having generally rectangular planforms, or with one or both ends being curved to form a semi-oval or oval shape. The cushion 10 is also adaptable for use in hot tubs having round, rectangular, square, or other planforms, as exemplified by the round hot tub cushion 10b of FIG. 5. It will be seen that any one of a number of colors or patterns may be molded into any of the embodiments of the present cushion at the time of manufacture, so the purchaser thereof may select a color and/or pattern which is complementary to the decor of the bathroom, spa, or other room in which the cushion is to be installed.

The present tub cushion in any of its various embodiments may be removably installed within a tub by fitting the cushion in place, and pressing the suction cups disposed over the outer surface thereof against the inner surface and edge or rim of the tub. The cushion may be removed easily for cleaning the cushion and/or tub, by pulling on one edge of the cushion to release the suction progressively from the suction cups until the cushion has been released from the tub. Alternatively, the present cushion may be provided in combination with a tub at the time of sale or installation, if desired.

Once the cushion has been installed, the tub may be filled with water to the level desired. The cushion does not seal tightly about the drain opening for the tub, and hence water will flow between the cushion and tub and will seek the level of the water contained within the cushion itself. This water layer (approximately one quarter to one half inch) between tub and cushion provides some additional cushioning effect in the event the bather should fall in the tub, and permits the bottom portion of the cushion to be made thinner than the upper portions thereof. The relatively thin bottom portion of the cushion in turn provides greater resistance to distortion, and thus more secure footing, for a bather standing upon the bottom surface thereof. However, the closed cell foam material of which the cushion is made, along with the water captured between tub and cushion, also provide the additional benefit of thermally insulating the remaining water within the cushion, thus allowing a bather to soak for a longer period of time before the water cools.

The audio system which may be provided optionally within the head rest of the present cushion, provides even greater comfort and convenience for the bather using the cushion. The audio system itself, being battery powered as well as being in an enclosure well above the water level of the tub, is essentially isolated from the bather and thus no danger of electrical shock exists. Yet, the audio system is readily accessible for tuning, installation of a tape cassette or compact disc, changing of batteries, etc., by means of the openable upper closure for the head rest.

Drainage of the tub in which the present cushion is installed is conventional, with water draining from within the cushion to the tub drain by means of the drain opening provided in the tub cushion. The drainage grooves radially disposed from the cushion drain, provide further efficiency in draining the cushion. Water which has flowed between the tub and the cushion will drain back to the tub drain as the water level within the cushion is lowered, with all water within the tub and cushion being eventually drained from the tub through the tub drain. Cleaning of the cushion is conventional, with mild, non-abrasive cleaners being suitable. It will be seen that the present cushion, in any of its embodiments, will be a most desirable accessory for the home and bath, as well as for institutional use, as it provides both additional safety and comfort for the user thereof.

It is to be understood that the present invention is not limited to the sole embodiments described above, but encompasses any and all embodiments within the scope of the following claims.

I claim:

1. A tub cushion comprising:

a thick, resilient liner adapted to be removably inserted within a conventional bathing tub, said cushion being formed as a single homogeneous, unbroken and continuous sheet having a bottom portion, a plurality of side walls extending upwardly therefrom, with said side walls having a common upper edge, and a rim extending outwardly from said sidewall upper edge and adapted to provide a cushioned cover overlapping the tub edge when said cushion is removably installed therein;

said cushion having an outer surface adapted to be disposed adjacent the surface of the tub when said cushion is removably installed therein, with said cushion outer surface including removable tub attachment means disposed generally uniformly thereover, said cushion includes a rear side wall having a head rest formed integrally therewith and extending upwardly therefrom; and, an audio system installed within said head rest.

2. The tub cushion according to claim 1, wherein:

said cushion is formed of closed cell foam plastic material.

3. The tub cushion according to claim 1, wherein:

said upper edge of said cushion is thicker than said bottom portion of said cushion, with the thickness tapering uniformly from said upper edge of said cushion to said bottom portion of said cushion.

4. The tub cushion according to claim 1, wherein:

said cushion has a thickness of between one and two inches.

5. The tub cushion according to claim 1, wherein:

said removable tub attachment means comprises a plurality of suction cups disposed over said outer surface of said cushion.

6. The tub cushion according to claim 1, wherein:

said bottom portion of said cushion includes a drain opening therein, with a plurality of drain channels extending radially from said drain opening and over said bottom portion of said cushion.

7. The tub cushion according to claim 1, wherein:

said cushion has a generally rectangular planform and is adapted to fit closely within a conventional bathtub.

8. The tub cushion according to claim 1, wherein:

said cushion has a generally round planform and is adapted to fit closely within a conventional hot tub.

9. A conventional bathing tub and a tub cushion therefor, comprising in combination:

a tub having a bottom, side walls, and an upper rim;

a thick, resilient liner adapted to be removably inserted within said tub, said cushion being formed as a single homogeneous, unbroken and continuous sheet having a bottom portion, a plurality of side walls extending upwardly therefrom with said side walls having a common upper edge, and a rim extending outwardly from said sidewall upper edge and adapted to provide a cushioned cover overlapping said tub rim when said cushion is removably installed therein;

said cushion having an outer surface adapted to be disposed adjacent the surface or said tub when said cushion is removably installed therein, with said cushion outer surface including removable tub attachment means disposed generally uniformly thereover, said cushion includes a rear side wall having a head rest formed integrally therewith and extending upwardly therefrom; and an audio system installed within said head rest.

10. The bathing tub and tub cushion combination according to claim 9, wherein:

said bathing tub comprises a conventional bathtub having a generally rectangular planform, and said cushion has a generally rectangular planform and is adapted to fit closely within said bathtub.

11. The bathing tub and tub cushion combination according to claim 9, wherein:

said bathing tub comprises a conventional hot tub having a generally round planform, and said cushion has a generally round planform and is adapted to fit closely within said hot tub.

12. The bathing tub and tub cushion combination according to claim 9, wherein:

said cushion is formed of closed cell foam plastic material.

13. The bathing tub and tub cushion combination according to claim 9, wherein:

said upper edge of said cushion is thicker than said bottom portion of said cushion, with the thickness tapering uniformly from said upper edge of said cushion to said bottom portion of said cushion.

14. The bathing tub and tub cushion combination according to claim 9, wherein:

said cushion has a thickness of between one and two inches.

15. The bathing tub and tub cushion combination according to claim 9, where in:

said removable tub attachment means comprises a plurality of suction cups disposed over said outer surface of said cushion.

16. The bathing tub and tub cushion combination according to claim 9, wherein:

said bottom portion of said cushion includes a drain opening therein, with a plurality of drain channels extending radially from said drain opening and over said bottom portion of said cushion.

* * * * *